US005809806A

United States Patent [19]

Yoon et al.

[11] Patent Number: 5,809,806

[45] Date of Patent: Sep. 22, 1998

[54] CLEANSING FABRIC AND METHOD FOR MANUFACTURING THE SAME

[75] Inventors: Jong Sun Yoon; Jae Soo Kim; Byung Joo Kim, all of Seoul, Rep. of Korea

[73] Assignee: Tong Yang Nylon Co., Ltd., Seoul, Rep. of Korea

[21] Appl. No.: 791,438

[22] Filed: Jan. 27, 1997

Related U.S. Application Data

[63] Continuation-in-part of Ser. No. 295,274, Aug. 24, 1994, abandoned.

[30] Foreign Application Priority Data

Aug. 28, 1993 [KR] Rep. of Korea ..... 93-16939

[51] Int. Cl.[6] ..... D04B 1/04

[52] U.S. Cl. ..... 66/196; 139/420 A; 66/202; 442/60; 15/209.1

[58] Field of Search ..... 139/420 A, DIG. 1; 428/229, 151, 904; 66/196, 202; 442/60; 15/209.1

[56] References Cited

U.S. PATENT DOCUMENTS

| | | | |
|---|---|---|---|
| 4,756,947 | 7/1988 | Nishikawa | 428/151 |
| 4,865,906 | 9/1989 | Smith, Jr. | 428/224 |
| 4,880,691 | 11/1989 | Sawyer et al. | 66/202 |
| 5,229,181 | 7/1993 | Daiber et al. | 428/58 |
| 5,557,950 | 9/1996 | Richards et al. | 66/202 |

FOREIGN PATENT DOCUMENTS

| | | | |
|---|---|---|---|
| 3-165728 | 7/1991 | Japan | 15/209.1 |
| 4-100945 | 4/1992 | Japan | 139/420 A |
| 4-126840 | 4/1992 | Japan | 139/420 A |

*Primary Examiner*—Andy Falik
*Attorney, Agent, or Firm*—Steinberg & Raskin, P.C.

[57] ABSTRACT

A cleansing fabric and a method for manufacturing cleansing fabric wherein in the method, separative type ultrafine fiber and highly shrinkable polyester fiber are circular knitted or interlaced such that the highly shrinkable polyester fiber is interposed between the separative ultrafine fibers to obtain a three-layered knitted structure and subjecting the three-layered structure to dyeing. The separative type ultrafine fiber is obtained by conjugate spinning of hydrophilic nylon and lipophilic polyester.

7 Claims, 3 Drawing Sheets

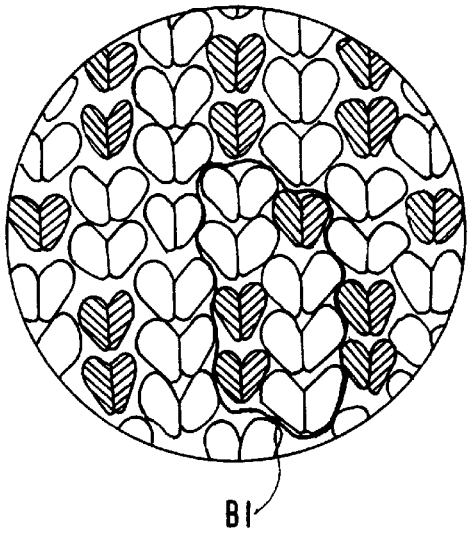
FIG. 1
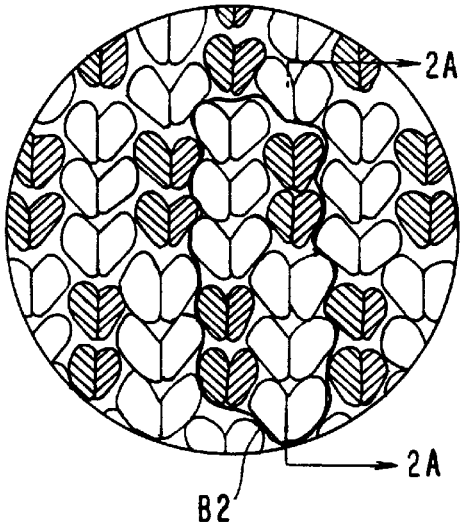
FIG. 2
FIG. 2A
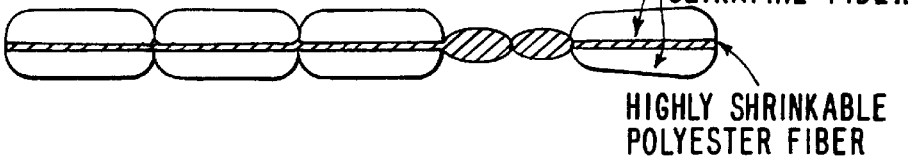

| | | | | | | | |
|---|---|---|---|---|---|---|---|
| X | O | X | O | X | O | 15 | 16 |
| X | X | X | X | X | X | 13 | 14 |
| O | X | O | X | O | X | 11 | 12 |
| O | X | O | X | O | X | 9 | 10 |
| X | O | X | O | X | O | 7 | 8 |
| X | X | X | X | X | X | 5 | 6 |
| O | X | O | X | O | X | 3 | 4 |
| O | X | O | X | O | X | 1 | 2 |
| A | | A | | A | | | |
| | B | | B | | B | | |

FEEDS NO

NEEDLE NO

FIG. 3

X : POLYESTER / NYLON COMPOSITE $70^D/36^F$

O : POLYESTER $40^D/24^F$

□ : BASIC STRUCTURE (5LOOP 3LOOP COMBINATION)

| | | | | | | | |
|---|---|---|---|---|---|---|---|
| X | O | X | O | X | O | 19 | 20 |
| X | O | X | O | X | O | 17 | 18 |
| X | X | X | X | X | X | 15 | 16 |
| O | X | O | X | O | X | 13 | 14 |
| O | X | O | X | O | X | 11 | 12 |
| X | O | X | O | X | O | 9 | 10 |
| X | O | X | O | X | O | 7 | 8 |
| X | X | X | X | X | X | 5 | 6 |
| O | X | O | X | O | X | 3 | 4 |
| O | X | O | X | O | X | 1 | 2 |
| A | | A | | A | | | |
| | B | | B | | B | | |

FEEDS NO

NEEDLE NO

FIG. 4

X : POLYESTER NYLON COMPOSITE $70^D/36^F$

O : POLYESTER $40^D/24^F$

□ : BASIC STRUCTURE ( 5LOOP )

UNDYED ULTRAFINE FIBER
(UNSEPARATED STATE)

UNDYED ULTRAFINE FIBER
(SEPARATED STATE)

CLEANSING FABRIC AND METHOD FOR MANUFACTURING THE SAME

This application is a continuation-in-part of U.S. patent application Ser. No. 08/295,274 filed Aug. 24, 1994.

BACKGROUND OF THE INVENTION

1. Field of the Invention

The present invention relates, in general, to a cleansing fabric having a high performance and, more particularly, to an improvement in the physical properties of a cleansing fabric and a method for manufacturing such a cleansing fabric.

2. Description of the Prior Art

Generally, cleansing fabric for polishing articles having extremely smooth surfaces, such as glasses, jewelry and piano, is not only soft and flexible but also is made of peculiar materials and has a special surface structure so as to cleanse the pollutants on the surface, such as dust and oily components.

Conventionally, it is well known that cleansing fabric can be obtained by interlock stitching (interlacing) a separative type composite yarn which results from conjugate spinning of hydrophilic nylon and lipophilic polyester, treating the stitched greige with benzyl alcohol and surfactant at high temperatures for a long time to separate the composite components, making the stitched greige shrink at a rate of not less than about 50% and applying an additional dyeing process to the material.

However, such a conventional method is complicated as well as unadvantageous vis-a-vis the cost of producing the fabric thereby. What is still worse, the conventional method causes serious environmental pollution due to the use of a large quantity of chemical pollutants, such as benzyl alcohol.

SUMMARY OF THE INVENTION

Therefore, an object of the present invention is to overcome the problems encountered in the prior art and to provide a method for manufacturing cleansing fabric which is superior in physical properties, especially, in cleansing power.

It is another object of the invention to provide a new and improved cleansing fabric made by interlacing two fibers or yarns.

It is still another object of the present invention to avoid producing excessive amounts of pollutants while manufacturing a cleansing fabric.

In accordance with the present invention, the above objects can be accomplished by a method for the manufacture of cleansing fabric comprising the steps of: stitching or interlacing separative type ultrafine fiber and highly shrinkable polyester fiber in such a way that the highly shrinkable polyester fiber is interposed between the separative type ultrafine fibers, to give a woven or knitted structure, the separative type ultrafine fiber resulting from conjugate spinning of hydrophilic nylon and lipophilic polyester; and subjecting the woven or knitting structure to dyeing as desired.

The knit fabric in accordance with the invention is made by circular knitting (another term used herein synonymously with interlacing) two sorts of fibers, viz., a separative type ultrafine fiber and highly shrinkable polyester fiber in conventional knitting machines.

BRIEF DESCRIPTION OF THE DRAWINGS

These and other objects of the invention will be described with reference to the description, taken in connection with the accompanying drawings, in which:

FIG. 1 shows a stitch structure of '5 loop and 3 loop combination repeat' employed in the cleansing fabric of the present invention;

FIG. 2 shows a stitch structure of '5 loop repeat' employed in the cleansing fabric of the present invention;

FIG. 2A is a longitudinal cross-section taken along the line 2A—2A in FIG. 2;

FIG. 3 shows a knitting structure plan for producing a knitted structure of the '5 loop and 3 loop combination repeat' employed in the cleansing fabric in accordance with the invention as shown in FIG. 1;

FIG. 4 shows a knitting structure plan for producing a knitted structure of the '5 loop repeat' employed in the cleansing fabric in accordance with the invention as shown in FIG. 2;

Figure 5A:
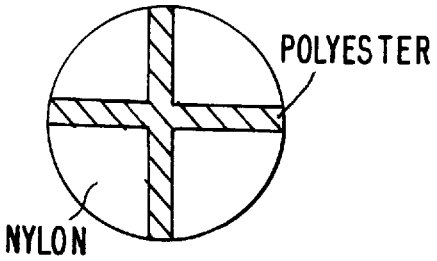
FIG. 5A shows the ultrafine fiber prior to its separation into its components.

To the accomplishment of the foregoing and related objects, this invention comprises the features of improvement hereafter fully described and the following description setting forth in detail certain illustrated embodiments of the invention.

DETAILED DESCRIPTION OF THE INVENTION

In accordance with the present invention, a highly shrinkable polyester fiber is interposed between separative type ultrafine fibers which are obtained by conjugate spinning of hydrophilic nylon and lipophilic polyester, to give a triaxial woven structure, and this structure is subjected to dyeing, to obtain fabric having a desired color pattern. The term "triaxial" as used herein is better defined as "pseudotriaxial" or "three-layered" (discussed in greater detail below) since the resultant cleansing fabric will be made of three layers of fibers, i.e., two layers of the separative type ultrafine fiber surrounding the highly shrinkable polyester fiber. As the dyeing process is carried out, the fabric shrinks at a rate of not less than 50% with microgrooves and macrogrooves being coexistent on both surfaces of the fabric. That is, the cleansing fabric according to the present invention is structured to be a three-layered woven structure consisting of both outer layers of the separative type ultrafine fiber and an interlayer of the highly shrinkable polyester fiber. The three-layered structure extends over a substantial portion of the fabric, but it is possible to have other portions having only one or two layers in view of the knitting or weaving pattern, e.g., a portion in which only the highly shrinkable polyester fabric is present.

The separative type ultrafine fiber used in the present invention is a physically and chemically separable composite yarn. Preferably, it is one which is obtained by conjugate spinning hydrophilic nylon component and lipophilic polyester component in a well-balanced combination and has the fineness of single yarn of not more than 0.1denier after physical separation in a subsequent dyeing process (discussed below with reference to FIGS. 5A and 5B). For example, if the fineness of single yarn is over 0.1 denier after separation, the cleansing fabric obtained is unsatisfactory in touch, sense and surface structure. In addition, if any one of the hydrophilic and lipophilic components is overly present relative to the other, it is not favorable due to the fact that the cleansing power for special pollutants is highly apt to be lowered. The ultrafine fiber used in the cleansing fabric of the present invention may be one which is processed in a greige state or in a stretched state.

With regard to the highly shrinkable polyester fiber used as the interlayer, it shrinks at rates ranging from approximately 50% to approximately 100% and preferably from approximately 60% to approximately 80% when it is treated in salt bath heated to 100° C. Fineness and other physical properties need not to be specified specially. Employment of one having a shrinkage rate of not more than 50% results in cleansing fabric having a shrinkage rate of not more than 50%, unbalancing the distribution of the micro grooves and macro grooves on the surface thereof as well as degrading the shrinkage restoring power and resilience thereof Accordingly, the polyester fiber used as the interposition layer should have a shrinkage rate within the suggested scope in consideration of the objective shrinkage of the fabric article to be finally obtained.

According to the present invention, the method for the manufacture of cleansing fabric is characterized by the interlayer of highly shrinkable polyester fiber when knitting the separative type ultrafine fiber and the highly shrinkable polyester fiber. Thus, a woven or knitted structure must be employed in the cleansing fabric of the present invention, and is preferably such a stitch structure as to have both outer surfaces composed efficiently of the separative type ultrafine fiber, to thereby defined two of the three layers. Preferred examples are shown in FIGS. 1 and 2, wherein '5 loop and 3 loop combination repeat' weave structure and a '5 loop repeat' weave structure are illustrated, respectively.

The knit fabric in accordance with the invention will have a plan view as shown in FIGS. 1 and 2 at the time of knitting. However, as noted above, it has a pseudotriaxial structure (pseudotriaxial geometry) in the state of grey knit fabric after finishing the knitting process (especially in the state of dyed knit fabric after finishing dyeing process) as shown in FIG. 2A. The effect of such a pseudotriaxial structure in the knit fabric is obtained by high shrinkage force according to the use of highly shrinkable polyester fiber. As shown in FIG. 2A, the cross-sectional view of the fabric shows a three-layered structure at certain locations, the first layer being a lower edge layer of separative type ultrafine fiber, the second layer being an upper edge layer of separative type ultrafine fiber and the third layer being a middle or intermediate layer of highly shrinkable polyester fiber. It should be recognized that some portions of the fabric do not have three-layered structure but have, e.g., only a layer of the highly shrinkable polyester fiber as shown in FIG. 2A.

The dyeing process used in the present invention may be conventional one for nylon and polyester components and therefore, the detailed description therefor is omitted herein.

The method for the manufacture of cleansing fabric according to the present invention excludes the treatment of the pollution-causing chemicals, such as benzyl alcohol, leading to the protection of environment as well as the reduction of production cost by at least 50%. In addition, the cleansing fabric obtained by the method of the present invention shows superior shape stability like textile with excellent smoothness and resilience. Furthermore, it is inclined not to be frayed after cutting. Especially, the ultrafine loop by the separated surface ultrafine fibers along with the high shrinkage of the polyester fiber interposed between the surface ultrafine fibers generates such a synergy effect that micro grooves and macro grooves are coexistent in appropriate combination on the surface of the cleansing fabric, which grooves facilitates to cleanse both micro dust particles and macro pollutants. Consequently, the cleansing fabric obtained by the method according to the method is very useful as a cleaner for an article having a surface which is frequently polished, such as glasses, jewelry, piano and the like.

The preferred embodiment of the present invention will now be further described with reference to specific examples.

EXAMPLE 1

Using polyester/nylon 80:20 composite $70^D/36^F$ 16 separative type ultrafine fibers and $40^D/24^F$polyester fibers having a boiling water shrinkage rate of 55%, a triaxial or three-layered woven structure of '5 loop and 3 loop combination repeat' as shown in FIGS. 1 and 3 was made in such a way that the $40^D/24^F$ polyester fibers were allowed to be an interlayer while the separative type ultrafine fibers constituted both outer layers. Thereafter, this greige was subjected to cutting and dyeing according to conventional technique, to obtain fabric.

The manufacture of a real or true triaxial woven structure is known in the art and is described, e.g, in U.S. Pat. Nos. 5,070,914, 4,040,451, 4,105,052 and 4,938,270, which are hereby incorporated by reference herein. The fabric in accordance with the invention can also be woven as such a true triaxial structure, i.e., a fabric having stitch loops in three different planes as shown in these patents, while maintaining the three layers of the fibers in accordance with the invention.

The fabric in accordance with the invention can be made by a universal interlock machine whereby the machine is programmed to interlace the two fibers in the inventive fabric, namely the highly shrinkable polyester fiber and the separative type ultrafine fiber. Certain knitting plans for the fabric in accordance with the invention is shown in FIGS. 3 and 4. The programming of such a knitting machine is within the skill of one of ordinary skill in the art.

With particular relevance to the fabric in FIG. 1, the fabric may be made under the knitting plan shown in FIG. 3 by a conventional, prior art Circular Knitting Machine with a diameter 30–36 inches, 2–4 track cylinders, 2 track dial and 18–32 Gauge sold by Ssangyong Machine Industries Co., Ltd. of Seoul, Korea under the model number SUID-96-High Production Universal Interlock Machine. Particularly, the fabric might be made with machine settings of 36 inch, 2 track cylinder, 2 track dial, 32 Gauge and 96 feeds, each feed folding one of the polyester/nylon composite 70D/36F (X) and polyester fiber 40D/24F (O) in conformity with the knitting structure plan of FIG. 3 which shows 16 feeds including 8 feeds in the basic structure. The basic structure shown in FIG. 3 corresponds to that portion of the fabric within box B1 in FIG. 1.

The obtained fabric was tested for various physical properties and the results are given as shown in the following Table 1.

COMPARATIVE EXAMPLE 1

Using the nylon/polyester separative ultrafine fiber of Example 1, a biaxial woven structure was made according to an interlock style. Thereafter, this greige was treated with benzyl alcohol and Summol-BK (trade name) and then subjected to dyeing, to obtain fabric. The obtained fabric was tested for various physical properties and the results are given as shown in the following Table 1.

TABLE 1

| Physical Properties | Example 1 | Comparative Example 1 |
|---|---|---|
| Shrinkage rate | 52% | 40% |
| Touch Sense | Textile touch | Knit touch |
| Thread Fray | Hard | Easy |
| Surface Effect | Micro/macro grooves balanced | Micro grooves mainly |
| Cleansing Effect | Excellent | Ordinary |
| Cost (relative) | 45 | 100 |

The shrinkage was determined by comparing the widths and weights of the specimen fabrics before and after the dyeing process. The cleansing effect was determined by assessing the quantity of dust remaining on a smooth surface of an object, after equal amounts of dust were scattered in several spots of the smooth surface of the object, and then the smooth surface was polished once with the cleansing fabric specimens using the same force.

With particular relevance to the '5 loop repeat" fabric in FIG. 1, the fabric may be made under the knitting plan shown in FIG. 4 by a conventional, prior art Circular Knitting Machine with a diameter 30–36 inches, 24 track cylinders, 2 track dial and 18–32 Gauge sold by Ssangyong Machine Industries Co.,Ltd. of Seoul, Korea under the model number SUID-60-High Production Universal Interlock Machine. Particularly, the fabric might be made with machine settings of 36 inch, 2 track cylinder, 2 track dial, 32 Gauge and 60 feeds, each feed folding one of the polyester/nylon composite 70D/36F (X) and polyester fiber 40D/24F (O) in conformity with the knitting structure plan of FIG. 4 which shows 10 feeds in the basic structure. The basic structure shown in FIG. 4 corresponds to that portion of the fabric within box B2 in FIG. 2.

Figure 5B:
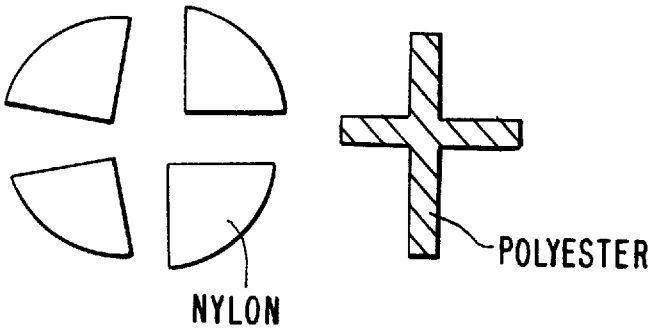
FIG. 5B shows the ultrafine fiber after its separation into its components.

FIG. 5A shows the ultrafine fiber (nylon/polyester conjugate yarn) in the state of un-dyed knit fabric and unseparated, i.e., the nylon and polyester conjugate consists of a integrated unit. However, after dyeing the fabric, each component of nylon and polyester in the fiber is separated from the other so that the ultrafine fiber has the cross-sectional shape as shown in FIG. 5B. This may be the ultrafine fiber used in the fabric in accordance with the invention. The degree of separation of the fiber is affected by the magnitude of the treating force (tension, friction, pressing force, etc.), treating time and treating temperature applied to the fabric during the dyeing process. After separation of the fiber by the dyeing process, the part of the ultrafine fiber in the fabric has a large volume in view of its separation effect and the high shrinkage effect of the shrinkable polyester fiber. As a result, the part of the ultrafine fiber in the dyed fabric has a large volume whereas the part of the shrinkable polyester fiber in the dyed fabric has a small volume, and thus the dyed fabric can be provided with a pseudotriaxial structure.

Other features, advantages and embodiments of the invention disclosed herein will be more apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed. For example, although the three-layered structure in accordance with the invention is described for the most part as being a knitted structure produced by circular knitting or interlacing, it is within the scope of the invention that the same materials, viz., the highly shrinkable polyester fiber and the separative type ultrafine fiber, could also be used in a weaving process to produce a cleansing fabric having a three-layered woven structure. In this case, the basic embodiment of the cleansing fabric in accordance with the invention, which can be made either by knitting or weaving, comprises a first edge layer of separative type ultrafine fiber, a second edge layer of separative type ultrafine fiber, and a third layer of highly shrinkable polyester fiber interposed between the first and second layers of separative type ultrafine fiber.

We claim:

1. A cleansing fabric comprising a first edge layer of separative type ultrafine fiber, a second edge layer of separative type ultrafine fiber, and a third layer of highly shrinkable polyester fiber substantially interposed between said first and second layers of separative type ultrafine fiber over a portion of the fabric.

2. The cleansing fabric of claim 1, further comprising dyes incorporated into at least one of said first, second and third layers to provide a color pattern of the fabric.

3. The cleansing fabric of claim 1, wherein said polyester fiber in said third layer is knitted with said ultrafine fiber in said first and second layers.

4. A method for manufacturing cleansing fabric, comprising the steps of:

circular knitting separative type ultrafine fiber and highly shrinkable polyester fiber to interpose at least a part of said highly shrinkable polyester fiber between said separative ultrafine fibers such that a three-layered knitted structure fabric is obtained thereat, said separative type ultrafine fiber resulting from conjugate spinning of hydrophilic nylon and lipophilic polyester; and subjecting the fabric to dyeing.

5. The method of claim 4, further comprising the step of:

separating said separative type ultrafine fiber after said dyeing step such that said separative ultrafine fiber has a fineness of not more than 0.1 denier.

6. A method for manufacturing cleansing fabric, comprising the steps of:

knitting separative type ultrafine fiber and highly shrinkable polyester fiber such that said separative type ultrafine fiber constitutes a first and outer layer of a knitted structure and at least a part of said highly shrinkable polyester fiber is interposed between said first outer layer and said second outer layer to thereby obtain a three-layered knitted structure fabric thereat, said separative type ultrafine fiber resulting from conjugate spinning of hydrophilic nylon and lipophilic polyester; and subjecting the three-layered knitted structure to dyeing.

7. The method of claim 6, further comprising the step of:

separating said separative type ultrafine fiber after said dyeing step such that said separative ultrafine fiber has a fineness of not more than 0.1 denier.

* * * * *